US006423962B1

(12) United States Patent
Pepper

(10) Patent No.: US 6,423,962 B1
(45) Date of Patent: Jul. 23, 2002

(54) TEST APPARATUS FOR TESTING DETECTORS

(75) Inventor: Stewart J. A. Pepper, Hertford (GB)

(73) Assignee: No Climb Products, Ltd., Barnet (GB)

( * ) Notice: Subject to any disclaimer, the term of this patent is extended or adjusted under 35 U.S.C. 154(b) by 0 days.

(21) Appl. No.: 09/172,966

(22) Filed: Oct. 14, 1998

(30) Foreign Application Priority Data

Oct. 14, 1997 (GB) ..... 9721782

(51) Int. Cl.[7] ..... H01J 40/14
(52) U.S. Cl. ..... 250/222.1; 340/630
(58) Field of Search ..... 250/222.1, 221, 250/239, 215, 551.4, 551.29; 340/514, 515, 520, 628, 630; 356/4.02, 375, 439, 440

(56) References Cited

U.S. PATENT DOCUMENTS 4,271,693 A * 6/1981 Bute ..... 73/1.03
5,170,148 A * 12/1992 Duggan et al. ..... 340/515
5,490,825 A * 2/1996 Wilkinson ..... 482/74
5,523,744 A * 6/1996 Wieser ..... 340/630
5,670,946 A * 9/1997 Ellwood et al. ..... 340/628

* cited by examiner

*Primary Examiner*—Que T. Le
*Assistant Examiner*—Thanh X. Luu
(74) *Attorney, Agent, or Firm*—Lumen Intellectual Property Services, Inc.

(57) ABSTRACT

A test apparatus for testing a detector such as a smoke detector or the like comprises a housing member pivotally mounted on the end of a pole and containing a test element for testing the detector. The housing member has an opening and is adapted to be placed over the detector under test. The presence of the detector within the housing member is sensed using a non-contact arrangement such as a photo-electric system and causes the tests to be activated to test the detector. A power supply for the test element is mounted in or on the pole adjacent the housing member and power is supplied to the test element using electrically conductive members which provide both mechanical and electrical connection between the housing member and the pole.

6 Claims, 1 Drawing Sheet

TEST APPARATUS FOR TESTING DETECTORS

CROSS-REFERENCE TO RELATED APPLICATIONS

This application is based on the UK application GB 9721782.2 filed Oct. 14, 1997, which is herein incorporated by reference.

FIELD OF THE INVENTION

The present invention relates to test apparatus for testing fixed detectors such as fire detectors in the form of heat and/or combined smoke detectors.

BACKGROUND ART

Fire detectors are normally mounted on the ceilings of rooms and internal spaces and detect the onset of a fire by either sensing an increase in temperature or the presence of the products of combustion, such as smoke. It is important that these detectors are routinely checked to ensure that they are operating properly due to the fact that they can remain in position for long periods of time without ever having been activated by a fire.

It is known, that a testing or test apparatus can be mounted at the end of a long pole to allow a person standing on the ground to place the test apparatus over a detector and then either apply a stimulus to the detector in order to trigger the detector and thereby test its operation. There are a number of problems associated with the presently available test apparatus. For example, one such apparatus is electrically powered by means of a battery pack attached to the user's belt which is connected to the test head by means of a cable which extends up the length of the pole to the test head and which is arranged to surround the detector being tested. Use of long cables is not advisable with high-power battery powered devices due to the fact that the cables themselves dissipate a considerable portion of the available battery power. Additionally, the cable connections at the end of the pole to the test head prevent the test head from freely moving on the end of the pole in order to adopt a suitable orientation with respect to the device being tested. These limitations are considerable when one understands that often the test head is on the end of a 9 meter pole. In addition, wear and tear on the cables, cable terminations, and cable connectors can lead to early failure of the electrical system, especially in the case where the cable and connections are continually flexed.

In another type of test apparatus, the test apparatus is manually activated by means of pressing the test head against a ceiling to activate a release mechanism for an aerosol can that emits aerosol to test the device in question. This type of apparatus also has its disadvantages. During a testing procedure, it is difficult to ensure adequate operation of the aerosol when trying to maneuver a 9 meter pole. Also when many detectors are mounted on suspended ceilings, which cannot resist the amount of pressure required in order to cause the mechanical activation of the aerosol can testing can, be tedious.

SUMMARY

An object of the present invention is to provide a test apparatus comprising a test head located on the end of a pole which overcome the problems associated with the presently available apparatus.

From one aspect, the present invention provides test apparatus comprising a test head adapted for mounting on the end of a pole. The test head comprises a housing member having an open portion adapted to be placed over a detector device being tested and means located within the open portion of the housing member for detecting the presence of the detector device. Preferably the presence detector is in the form of a non-contact arrangement such as is provided by a photo-emitting device and a photo-receiver.

In one mode of operation, light from a photo emitting device is received by the receiver until the detector device is interposed between the photo-electric elements, whereupon a test of the detector device is initiated. The test can be initiated by emission of an aerosol or the activation of a heating element or some other arrangement depending on the type of detector device being tested.

From another aspect, the present invention provides battery powered apparatus mounted on the end of a hollow elongated member and a battery retainer mounted to the housing member, thereby obviating the need for electrical cable from a power source, which may have been situated with the user, to the housing member.

Preferably the battery is readily removable to permit recharging or replacement of the batteries. Advantageously, the battery retainer is in the form of a housing which extends over a length of the elongate member in excess of the dimension of one battery so that the weight of the battery is evenly distributed along the length of the elongate member. The elongate member is arranged to be held by a user at a position remote from the battery compartment.

Preferably the apparatus is adapted for testing the operation of a detector device. In this case, the apparatus includes a housing member having an open portion arranged to be placed over a detector device under test.

From a further aspect, the present invention provides apparatus for testing the operation of a detector device comprising a housing member adapted to be placed over a detector device under test, the housing member being pivotally mounted on the end of an elongate member and is provided with an electrically operated arrangement. The pivotal mounting being arranged to include sturdy electrically conductive members and the elongate member, thereby obviating the need for electrical cable between the housing member and the elongate member.

It will be appreciated that the electrical and mechanical mounting construction could be used with the first and the second aspects of the present invention described above or can be used separately to simply replace the conventional wiring arrangement of the presently available test apparatus.

BRIEF DESCRIPTION OF THE FIGURES

In order that the present invention may be more readily understood, an embodiment thereof will now be described by way of example with reference to the accompanying drawings in which.

DETAILED DESCRIPTION

The present invention will be described in relation to its use as a test apparatus for testing a heat detector but it will be appreciated that it could be modified to suit apparatus for testing other types of detectors or remotely performing any task requiring remote power and/or automatic sensing and/or remote activator means.

Figure 1:
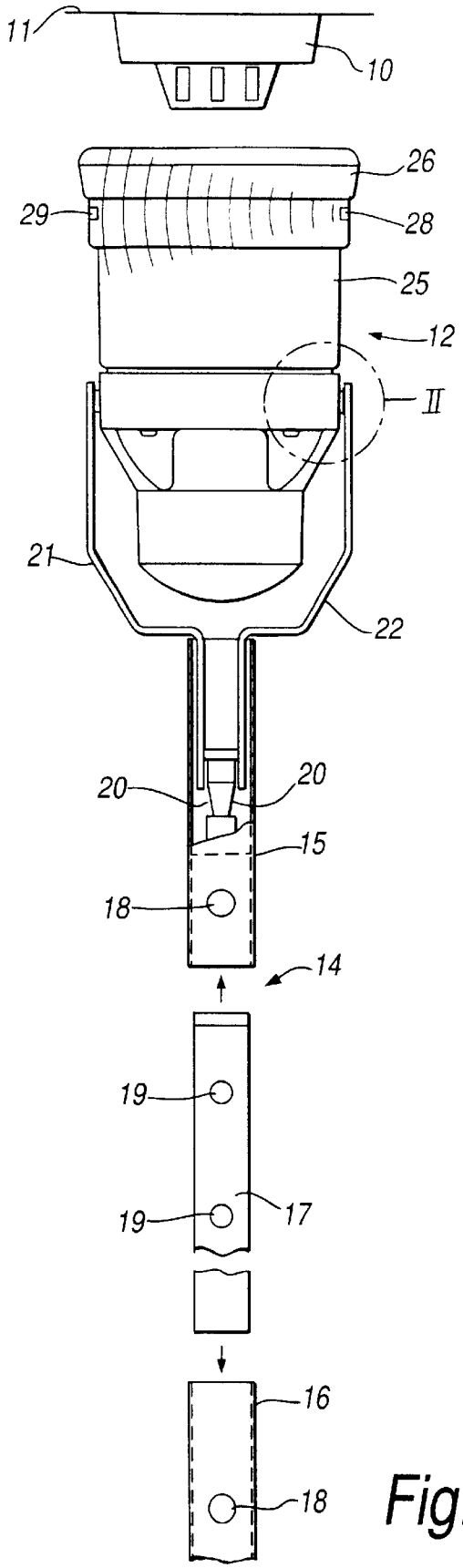
FIG. 1 shows a diagrammatic view of test apparatus according to the present invention.

In FIG. 1, a fire detector 10 is mounted on a ceiling 11. The test apparatus comprises a housing member generally indicated by the reference numeral 12 which is pivotally mounted on the end of a pole generally indicated by the reference numeral 14. The pole is in the form of a hollow tube which may be telescopic and is seen to comprise at least two sections namely a head section 15 to which the housing member 12 is mechanically attached and a support portion 16 which will be ultimately held by a user. A battery pack 17 is received within the bore of the tube 14 and may be used to structurally link the portions 15 and 16 together by means of projections 18 and recesses 19. Alternatively, the battery pack can simply be received inside one or both of the tube portions 15 and 16 which are then mechanically snapped together in a conventional manner. In any event, the battery pack provides dc power via conductors 20 which make contact with electrically conductive mounting brackets 21 and 22 which are rigidly attached to the end of the section 15. The housing member 12 is pivotally attached to the ends of the mounting members 21 and 22 by means of special pivot arrangements which will be described later in relation to FIG. 2.

The housing member 12 is formed from a cup-shaped member 25 the open end of which is surrounded by a sealing ring 26 which extends beyond the end of the cup-shaped member 25 to provide a seal with the ceiling 11 when the apparatus is in position with the fire detector 10 received within the cup-shaped member 25. Alternatively, the sealing ring can be replaced by a sealing membrane stretched across the open end of the cup-shaped member 25 but which has an aperture at its center into which the detector 10 can fit thereby forming a seal around the detector.

The presence of the detector 10 within the cup-shaped member 25 is detected using a non-contact arrangement. In the present case the arrangement is a photoelectric but any other non-contact arrangement such as an ultrasonic or capacitive arrangement could be utilized. In any event, the photoelectric arrangement comprises a photoelectric emitter 28 which is arranged to emit a beam of light which will normally be received by a receiver 29 unless the detector 10 is located between the emitter 28 and the receiver 29. The advantage of this arrangement is that little or no pressure on the ceiling is required in order to operate the test apparatus and the physical attributes of the detector are not critical as the membrane stretches to suit many shapes and sizes of detector. Further, it is a simple operation and it can be used to generate an initiation signal for a test sequence or operation. This is particularly important in relation to an arrangement whereby a heater coil is energized in order to provide a heat source for testing the detector 10. It would be very wasteful of power to maintain the heater in operation at all times and so the detector system for detecting the presence of the detector 10 in the housing 25 can be used to switch on the heater element or other test and so conserve power when the heater is not required e.g. when moving from detector to detector. A further advantage of this is that the apparatus can be put into an energized, standby mode and then only actively used when a detector 10 is sensed in the member 25.

Figure 2:
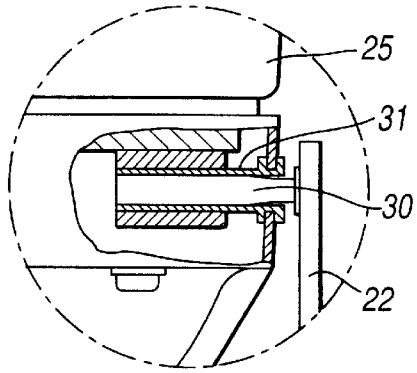
FIG. 2 shows in detail a part of the apparatus shown in FIG. 1.

Referring now to FIG. 2, this shows a broken away detail of one of the pivotal bearing members for mounting the housing member 25 on to the members 21 and 22. The description will be given in respect of the member 22 but the same description applies to the member 21.

The member 22 is made of an electrically conductive material such as aluminum but externally coated with an insulating material. A Conductive pin 30 extends at right angles from the member 22 into a conductive receptacle 31 mounted on the housing member 25 to permit the member 25 to pivot with respect to the members 21 and 22. Electrical connection can then be made from the conductive receptacle 31 to any electrical apparatus mounted in the housing 25.

The above construction where the battery is located at least partially in the elongated section 15 to which the housing member 25 is pivotally attached results in short conductive paths between the battery and the electrical device or element which requires to be powered by the battery. This reduces losses and also problems which may exist due to the use of flexible leads. Also, there is no need to make a number of electrical connections when preparing for use as has been the case in the past.

It will be appreciated that while the above description has been given in relation to generated heat using an electrically powered heating element, it would be possible to operate a different device. For example, an aerosol could be operated by an electrical solenoid which is energized to occasionally depress the valve of an aerosol can to release an aerosol into the confirned space in the cup-shaped member 25. The aerosol is of a substance specific to the detector under test.

Further modifications can include an audible and/or visible indication of battery life, an audible and or visible indication that the device is on standby, a different indication when the test is actually occurring and finally a warning indication when the battery is about to reach full discharge.

As mentioned above, the provision of a non-contact detection system for detecting the presence of an alarm detector under test in the test equipment can be utilized separately top the other features described above. Additionally, the provision of the battery at a position close to the sensing head is also a feature which could be used separately or in combination with the contactless detection system. Finally, the mounting system for the cup-shaped member which provides both electrical and mechanical connection between the end of the pole and the cup-shaped member is a feature which could be used separately or in combination with either or both of the other features.

What is claimed is:

1. A test apparatus comprising a housing member having an opening and being adapted to be placed over a detector device under test, means located within the housing member for detecting the presence of the detector device, wherein the presence detecting means is a non-contact arrangement comprising an emitter and a receiver, and a test element for testing the device when received in the housing member, the test element being activated in response to the presence detecting means.

2. The test apparatus according to claim 1, wherein the presence detecting means includes photo-electric elements.

3. A test apparatus for testing the operation of a detector device comprising an electrically operated device mounted at the end of a hollow elongate member, and means forming a power supply retainer with in the hollow elongate member adjacent to the electrically operated device, the elongate member being arranged to be held by a user at a position remote from the means forming the power supply retainer, wherein the electrically operated device comprises a presence detecting means having an emitter and a receiver for detecting presence of the detector device in a non-contact arrangement, and wherein the presence of the detector device activates the testing of the operation of the detector device.

4. The test apparatus according to claim 3, wherein the electrically operated device further comprises a test element for the testing of the operation of the detector device and a housing member having an opening adapted to be placed over the detector device under test.

5. The test apparatus according to claim 4, wherein the power supply retainer is in the form of a compartment which is elongate and extends over a substantial portion of the elongate member.

6. A test apparatus for testing the operation of a detector device comprising a test element, a presence detecting means and a housing member adapted to be placed over the detector device under test, wherein the housing member being pivotally mounted on the end of an elongate member and being provided with an electrically operated arrangement, the pivotal mounting being arranged to include electrically conductive members, each of which provides both mechanical and electrical connection between the housing member and the elongate member, wherein the presence detecting means having an emitter and a receiver detects presence of the detector device in a non-contact arrangement, and wherein the presence of the detector device activates the testing of the operation of the detector device by the test element.

* * * * *